US005114312A

United States Patent [19]

Stanislao

[11] Patent Number: 5,114,312

[45] Date of Patent: May 19, 1992

[54] SLURRY PUMP APPARATUS INCLUDING FLUID HOUSING

[75] Inventor: Joseph Stanislao, Fargo, N. Dak.

[73] Assignee: ATSCO, Inc., Belgrade, Mont.

[21] Appl. No.: 714,698

[22] Filed: Jun. 13, 1991

Related U.S. Application Data

[62] Division of Ser. No. 538,985, Jun. 15, 1990.

[51] Int. Cl.[5] ..... F04D 29/42

[52] U.S. Cl. ..... 415/206; 415/225; 415/912

[58] Field of Search ..... 415/203, 206, 225, 912; 417/900

[56] References Cited

U.S. PATENT DOCUMENTS

| | | | |
|---|---|---|---|
| 3,510 | 3/1844 | Johnson . | |
| 3,959 | 3/1845 | Aylsworth . | |
| Re. 24,803 | 3/1960 | Burnside . | |
| 1,161,701 | 11/1915 | Le May . | |
| 2,270,686 | 1/1942 | Moore . | |
| 2,466,812 | 4/1949 | Jacobsen . | |
| 2,635,548 | 4/1953 | Brawley . | |
| 2,785,930 | 3/1957 | Burnside . | |
| 2,958,293 | 11/1960 | Pray . | |
| 2,994,275 | 8/1961 | Stepnica . | |
| 3,171,357 | 3/1965 | Egger . | |
| 3,190,226 | 6/1965 | Judd . | |
| 3,269,325 | 8/1966 | Schweb et al. . | |
| 3,319,573 | 5/1967 | Judd . | |
| 3,380,673 | 4/1968 | Van Lenten et al. . | |
| 3,394,655 | 7/1968 | Brown . | |
| 3,543,368 | 12/1970 | Marlow | 415/912 |
| 3,679,323 | 7/1972 | Buck . | |
| 3,759,628 | 9/1973 | Kempf . | |
| 3,779,668 | 12/1973 | Ekey . | |
| 3,953,552 | 4/1976 | Strauss . | |
| 4,129,402 | 12/1978 | Eberhardt . | |
| 4,386,886 | 6/1983 | Neal . | |
| 4,475,868 | 10/1984 | Renger . | |
| 4,556,364 | 12/1985 | Barker . | |
| 4,575,308 | 3/1986 | Corkill . | |
| 4,592,700 | 6/1986 | Toguchi et al. . | |
| 4,596,511 | 6/1986 | Weinrib . | |
| 4,676,718 | 1/1987 | Sarvanne . | |
| 4,680,006 | 7/1987 | Fisher . | |
| 4,776,753 | 10/1988 | Weinrib . | |
| 4,792,275 | 12/1988 | Weinrib . | |

FOREIGN PATENT DOCUMENTS

| | | |
|---|---|---|
| 2353456 | 4/1975 | Fed. Rep. of Germany . |
| 53-403 | 1/1978 | Japan . |

OTHER PUBLICATIONS

SAE Technical Paper Series, No. 891492, "A Study on New Centrifigal Pump for Slurries," Mariusz Ziewjewski, Joseph Stanislao, Sherman Goplen & Tiat Eng Wee, 9 pages dated Sep. 1989, labelled Exhibit A.

SST, Inc., Brochure entitled, "Burly Vortex Slurry Pump," 2 pages, labelled Exhibit B.

Manuscript entitled, "Burly Vortex Slurry Pump," by J. Stanislao and M. Ziewjewski, 24 pages, labelled Exhibit C.

*Primary Examiner*—Edward K. Look

*Assistant Examiner*—James A. Larsen

*Attorney, Agent, or Firm*—Merchant, Gould, Smith, Edell, Welter & Schmidt

[57] ABSTRACT

A slurry pump is provided having an impeller housing with an impeller chamber receiving an impeller having a rotation axis and a plurality of wedge-shaped pockets on a fluid engaging face. A fluid housing is adjacent to and cooperates with the impeller housing to form a fluid chamber adjacent the impeller. An input passage to the fluid housing is perpendicular to and offset from the rotation axis and links an exterior of the slurry pump to the fluid chamber to permit fluid to enter the pump. An output passage from the fluid housing links the fluid chamber to an exterior of the pump to permit fluid to exit the pump. A feedback input passage links the output passage back to the fluid chamber to permit a portion of the fluid exiting the pump to reenter the fluid chamber, thus creating a dynamic and continual prime. The fluid housing includes a circular wall member with an input passage eccentrically located relative to the circular wall member and the rotation axis of the impeller. The fluid housing further includes a side wall member including the output passage, with the side wall member surrounding the circular wall member and cooperating with the circular wall member to define the fluid chamber. The side wall member has an interior width substantially equal to the inside diameters of the input and output passage. The capacity of the pump can be changed by interchanging different fluid housings.

7 Claims, 3 Drawing Sheets

10
20
40
26
24
56
54
22
42
84
80
86
78
70
32
76
92
72
88
90
12
14
98
18
74

SLURRY PUMP APPARATUS INCLUDING FLUID HOUSING

This is a division of application Ser. No. 07/538,985, filed Jun. 15, 1990.

FIELD OF THE INVENTION

The present invention relates generally to a pump for pumping fluid, and particularly to a pump for pumping slurry, a fluid containing insoluble matter.

BACKGROUND OF THE INVENTION

Slurry, defined as fluid containing insoluble matter such as sand, gravel or other solid material, is sometimes transported from one location to another through the use of a pump. Often the pump has a pump housing containing an internally mounted, rotating rotor or impeller which engages slurry entering the pump and drives the slurry to exit to the pump.

One problem that arose in the past when pumping slurry using some conventional pumping apparatus is that the insoluble matter in the slurry sometimes caused excessive wear and damage to the pumping apparatus through contact with the parts of the pumping apparatus, especially the impeller. To address this problem, some pumps were designed to reduce the amount of contact between the slurry and the parts of the pump. In general, these slurry pumps have an empty space, or fluid chamber, in the pump housing that permits slurry to travel from an input passage to the pump housing to an output passage from the pump housing while reducing contact between the slurry and the parts of the pump. In slurry pumps, the rotating impeller is typically located adjacent to and substantially outside the fluid chamber. By forming a fluid chamber in the pump housing adjacent the impeller, the impeller can move the slurry entering the pump through the input passage toward the output passage while reducing contact between the slurry and the impeller.

Many conventional slurry pumps having a fluid chamber designed to reduce contact between the pump and the slurry are versatile in that, in addition to pumping slurry, they may be used to pump fluid containing little or no insoluble matter. Since slurry pumps can be used to pump either slurry or fluid, the term "fluid" as used herein will include fluid with or without insoluble matter.

One problem encountered with some conventional slurry pumps that have a fluid chamber is that irregularities or deviations in the fluid flowing through the pump housing from the input passage to the output passage may cause the pump to lose head or prime. These irregularities may be caused by solid matter or gas bubbles in the fluid. When irregularities cause the pump to lose prime, the pump no longer moves fluid through the pump housing. To begin pumping again, the pump must be reprimed, which can be a time consuming process.

Another problem encountered with some conventional slurry pumps is that the output flow of fluid from the pump is not uniform and pulsates. A pulsating fluid flow from the output passage produces undesirable pulsating reactionary forces on the output passage that may make the output passage difficult to control.

It is clear that there has existed a long and unfilled need in the prior art for a slurry pump that solves these and other problems associated with the prior art.

SUMMARY OF THE INVENTION

This invention relates to a slurry pump having an impeller with an axis of rotation and a fluid engaging face. The slurry pump further has an impeller housing with an impeller chamber for receiving the impeller. The impeller is rotatably mounted in the impeller chamber for rotation about the axis of rotation of the impeller. The slurry pump further includes a fluid housing which is adjacent to and cooperates with the impeller housing to form a fluid chamber. The impeller is located substantially outside the fluid chamber. The fluid housing has an input passage which links an exterior of the fluid housing to the fluid chamber. The fluid housing further has an output passage which links the fluid chamber to an exterior of the fluid housing. The input passage permits fluid entering the fluid chamber to engage the fluid engaging face of the impeller during rotation of the impeller about the axis of rotation. The impeller directs the fluid through the fluid chamber toward the output passage to exit the fluid chamber. The fluid housing further has a feedback input passage which links the output passage back to the fluid chamber. The feedback input passage permits a portion of the fluid exiting the fluid chamber through the output passage to reenter fluid chamber.

This invention further relates to a slurry pump having an impeller with an axis of rotation and a fluid engaging face. The slurry pump further includes an impeller housing having an impeller chamber for receiving the impeller. The impeller is rotatably mounted in the impeller chamber for rotation about the axis of rotation. The slurry pump further includes a fluid housing which is adjacent to and cooperates with the impeller housing to form a fluid chamber. The impeller is located substantially outside the fluid chamber. The fluid housing has an input passage linking an exterior of the fluid housing to the fluid chamber. The input passage is generally parallel to the axis of rotation of the impeller. The input passage further has a centerline which is offset from the axis of rotation of the impeller. The fluid housing further has an output passage linking the fluid chamber to an exterior of the fluid housing. The input passage permits fluid entering the fluid chamber to engage the fluid engaging face of the impeller during rotation of the impeller about the axis of rotation. The impeller directs the fluid through the fluid chamber toward the output passage to exit the fluid chamber.

This invention also relates to a slurry pump that has an impeller with a generally circular plate-shaped base member having an axis of rotation located perpendicular to the base member and adjacent a center of the base member. The base member has a fluid engaging surface. The impeller further has a plurality of fluid engaging blade members disposed on the fluid engaging surface of the base member. The blade members are generally uniform in thickness. The blade members converge adjacent the center of the base member and extend longitudinally in a general radial direction from the center of the base member toward an outer periphery of the base member. The impeller further includes a fluid engaging rim extending from the fluid engaging surface of the base member and surrounding the outer periphery of the base member. The blade members, the rim, and the fluid engaging surface of the base member cooperate to form a plurality of wedge-shaped pockets in the impeller wherein each blade member forms a side wall of adjacent pockets and each pocket has increasing cross-sectional area in the radial direction. The slurry pump further includes an impeller housing having an impeller chamber for receiving the impeller. The impeller is rotatably mounted in the impeller chamber for rotation about the axis. The slurry pump further includes a fluid housing adjacent to and cooperating with the impeller housing to form a fluid chamber. The impeller is located substantially outside the fluid chamber. The fluid housing further has an input passage linking an exterior of the fluid housing to the fluid chamber. The fluid housing further having an output passage which links the fluid chamber to an exterior of the fluid housing. The input passage permits fluid entering the fluid chamber to enter the pockets in the impeller during rotation of the impeller about the rotation axis. The impeller directs the fluid through the fluid chamber toward the output passage to exit the fluid chamber.

This invention further relates to a fluid housing which is mountable to an impeller housing of a slurry pump wherein the impeller housing contains a rotatable impeller. The fluid housing includes a circular wall member having a circular input passage eccentrically located relative to a center of the circular wall member. The fluid housing further includes a side wall member surrounding the circular wall member. The side wall member has a circular output passage. The side wall member is mountable to the impeller housing wherein the circular wall member and the side wall member cooperate with the impeller housing to define a fluid chamber. The impeller of the impeller housing is located substantially outside the fluid chamber. The side wall member has an interior width which is substantially equal to an inside diameter of the input passage and an inside diameter of the output passage.

This invention further relates to an impeller member for use in a slurry pump wherein the impeller member includes a generally circular plate-shaped base member. The base member has a rotation axis located perpendicular to the base member and adjacent a center of the base member. The base member has a fluid engaging surface. The impeller member further has a plurality of fluid engaging blade members disposed on the fluid engaging surface of the base member. The blade members have generally uniform thickness. The blade members converge adjacent the center of the base member and extend longitudinally in a general radial direction from the center of the base member toward an outer periphery of the base member. The impeller member further includes a fluid engaging rim extending from the fluid engaging surface of the base member and surrounds the outer periphery of the base member. The blade members, the rim, and the fluid engaging surface of the base member cooperate to form the plurality of wedge-shaped pockets in the impeller. Each blade member forms side wall of adjacent packets and each pocket has increasing cross-sectional area in the radial direction.

This invention also relates to a slurry pump having an impeller with an axis of rotation and a fluid engaging face. The slurry pump further has a pump housing where the impeller is rotatably mounted in an interior of the pump housing for rotation about the axis of rotation. The pump housing further has an input passage and an output passage linking the interior of the pump housing to an exterior of the pump housing. The input passage permits fluid entering the pump housing through the input passage to engage the fluid engaging face of the impeller during rotation of the impeller about the axis of rotation. The impeller directs the fluid through the pump housing toward the output passage to exit the pump housing. The pump housing further has a feedback input passage linking the output passage back to the interior of the pump housing. The feedback passage permits a portion of the fluid extending the interior of the pump housing through the output passage to reenter pump housing.

This invention further relates to a slurry pump have an impeller with an axis of rotation and a fluid engaging face. The invention further has a pump housing with the impeller being rotatably mounted in an interior of the pump housing. The pump housing has an input passage and an output passage linking an exterior of the pump housing to the interior of the pump housing. The input passage is located generally parallel to the axis of rotation of the impeller. The input passage further has a centerline which is offset from the axis of rotation. The input passage permits fluid entering the pump housing to engage the fluid engaging face of the impeller during rotation of the impeller about the axis of rotation. The impeller directs the fluid through the pump housing toward the output passage to exit the pump housing.

The present invention also relates to an adjustable capacity pump having an impeller with an axis of rotation and a fluid engaging face. The adjustable capacity pump further has an impeller housing with an impeller chamber receiving the impeller. The impeller is rotatably mounted in the impeller chamber for rotation about the axis of rotation. The adjustable capacity pump further has a fluid housing with a circular wall member opposing the fluid engaging face and a side wall member surrounding the circular wall member. The fluid housing cooperates with the impeller housing to form a fluid chamber defined by the circular wall member, the side wall member, and the fluid engaging face. The impeller is located substantially outside the fluid chamber. The circular wall member has an input passage linking an exterior of the fluid housing to the fluid chamber. The side wall member has an output passage linking the fluid chamber to an exterior of the fluid housing. The input passage permits fluid entering the fluid chamber to engage the fluid engaging face of the impeller during rotation of the impeller. The fluid is directed by the impeller through the fluid chamber toward the output passage to exit the fluid chamber. The capacity of the pump is adjustable by interchanging the fluid housing with another fluid housing wherein an inside diameter of the input passage and an inside diameter of the output passage are varied by interchanging the fluid housing.

This invention also relates to a slurry pump apparatus kit having an impeller with an axis of rotation and a fluid engaging face. The kit further has an impeller housing with an impeller chamber for receiving the impeller. The impeller is rotatably mountable in the impeller chamber for rotation about the axis of rotation. The kit further has a plurality of interchangeable fluid housings wherein each housing has a circular wall member an a side wall member surrounding the circular wall member. Each fluid housing interchangeably cooperates with the impeller housing to form a fluid chamber defined by the fluid engaging face of the impeller and the circular wall member and the side wall member of each fluid housing. The impeller is located substantially outside the fluid chamber. Each fluid housing has an input passage and an output passage linking the fluid chamber to an exterior of the fluid housing. The input passage permits fluid entering the fluid chamber to engage the fluid engaging face of the impeller during rotation of the impeller. The fluid is directed by the impeller through the fluid chamber toward the output passage to exit the fluid chamber. Each fluid housing further has equal dimensions for an interior width of the side wall member, an inside diameter of the input passage, and an inside diameter of the output passage. Each fluid housing further has different dimensions than the other fluid housings.

BRIEF DESCRIPTION OF THE DRAWINGS

In the drawings, wherein like reference numerals generally indicate corresponding parts throughout the several views.

DETAILED DESCRIPTION OF THE PREFERRED EMBODIMENTS

Figures 1, 2:
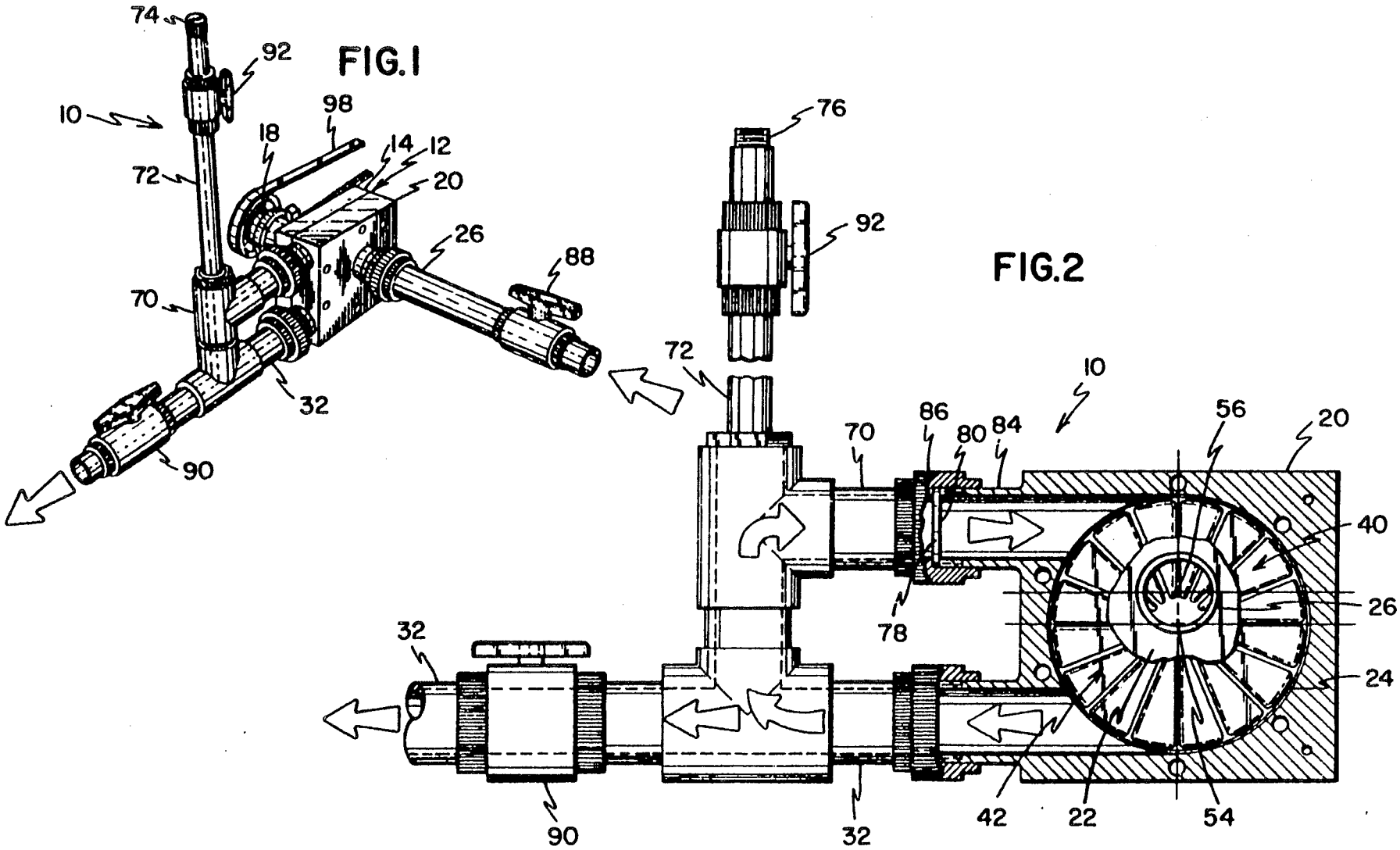
FIG. 1 is a perspective view of an embodiment of a slurry pump according to the present invention.
FIG. 2 is a front partial sectional view of the slurry pump shown in FIG. 1 with a portion of the fluid housing removed.

Referring now to FIGS. 1 and 2, a preferred embodiment of a slurry pump 10 in accordance with the principles of the present invention is shown in perspective view. The slurry pump 10 has a pump housing 12 which encloses a rotatable rotor, turbine-fan, or impeller 40 with a fluid engaging face 42 (the impeller is not visible in FIG. 1). An input passage 26 links an exterior of the pump housing 12 to an interior of the pump housing. An output passage 32 links an interior of the pump housing 12 to an exterior of the pump housing 12. The slurry pump 10 of the present invention is, in particular, intended to be used to pump slurry, although it can be used to transport either slurry or fluid without insoluble matter from the input passage 26 to the output passage 32. As noted above, the word "fluid" includes both slurry and fluid without insoluble matter.

During operation, a distal end of the input passage 26 is inserted into the fluid to be transported from one location to another. Through rotation of the impeller 40, a pressure differential or suction is created which forces the fluid into the pump housing 12 through the input passage 26. The input passage 12 is positioned to permit the fluid to contact the fluid engaging 42 face of the rotating impeller 40. The impeller 40 drives the fluid toward the output passage 32 to exit the pump housing 12 thereby transporting the fluid from the input passage 26 to the output passage 32. The fluid exits the output passage 32 at a distal end of the output passage. Arrows in Figure 1 indicate the direction of fluid flow through the pump.

Figure 3:
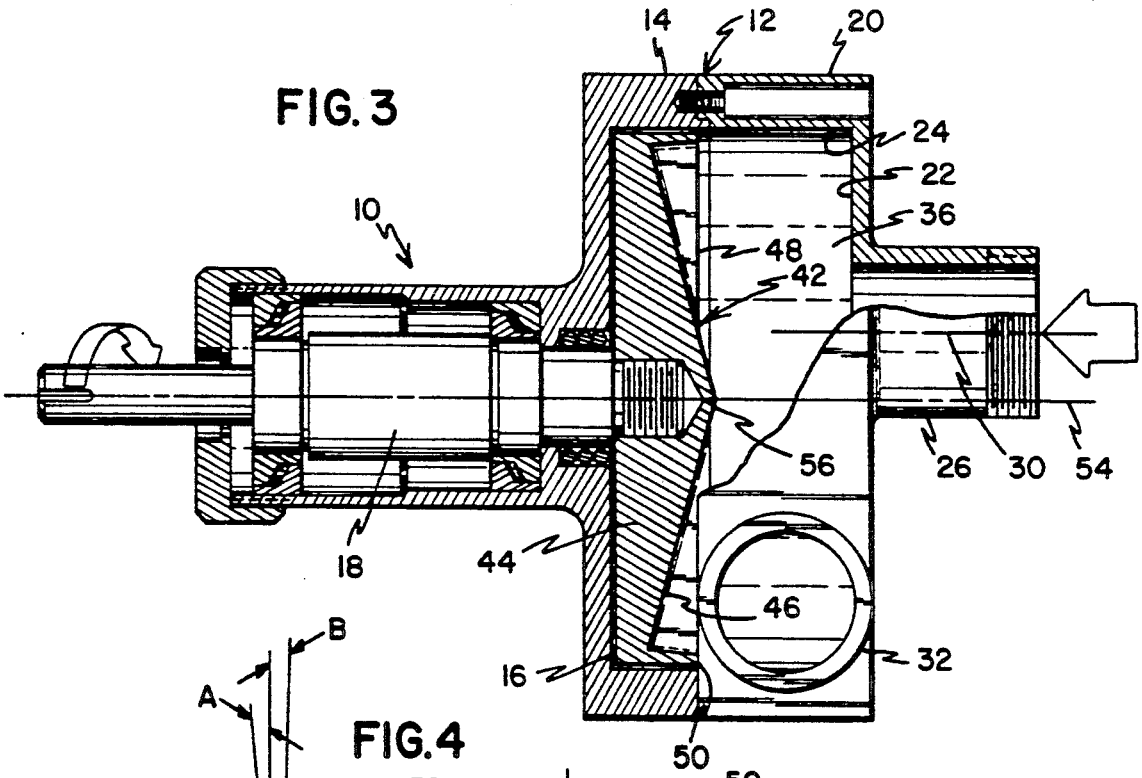
FIG. 3 is a left side partial sectional view of the slurry pump shown in FIG. 1 with a portion of the impeller housing and a portion of the fluid housing removed and further showing the impeller in cross-sectional view.

As shown in FIG. 1, the pump housing 12 has two mating halves, an impeller housing 14 and a fluid housing 20. Referring now to FIG. 2 and FIG. 3, the impeller housing 14 has an impeller chamber 16 which receives the impeller 40. The impeller 40 is mounted to one end of an elongated shaft 18 rotatably mounted to and extending through the impeller housing 14. The shaft 18 forms an axis of rotation 54 for the impeller 40. In the preferred embodiment, the shaft 18 has a cylindrical cross-sectional shape. The opposite end of the shaft 18 is driven by any suitable driving apparatus including an internal combustion engine (not shown). The driving apparatus can be connected to the shaft by any suitable structure including a fan belt 98 as is shown in FIG. 1.

The fluid housing 20 is adjacent to and cooperates with the impeller housing 14 to form a fluid chamber 36 adjacent the impeller 40. The fluid chamber 36 is formed by a circular wall member 22 of the fluid housing 20; a side wall member 24 of the fluid housing 20 extending around the circular wall member toward the impeller housing 14; and the fluid engaging face 42 of the impeller 40. The impeller 40 is located substantially outside of the fluid chamber 36. The input passage 26 passes through the circular wall member 22 and links an exterior of the pump housing 12 to the fluid chamber 36. The output passage 32 passes through the side wall member 24 and links the fluid chamber 36 to an exterior of the pump housing 12. The fluid chamber 36 connects the input passage 26 to the output passage 32 and presents a generally unobstructed pathway for fluid to pass through the pump housing 12 during operation.

As best shown in FIGS. 2 and 3, the input passage 26 in the preferred embodiment enters the fluid chamber 36 generally perpendicular to the axis of rotation 54 of the impeller 40. In addition, a centerline 30 of the input passage 26 preferably is offset from the axis of rotation 54 of the impeller 40. More preferably, the centerline 30 of the input passage 26 is offset at least one-eighth and no greater than one-half of an inside diameter of the input passage 26.

As best shown in FIG. 2, the output passage 32 is generally tangential to an outer periphery 58 of the impeller 40. The output passage 32 is also generally perpendicular to the axis of rotation 54 of the impeller 40. The fluid housing 20 shown in FIG. 2 has a concentric circular shape. Unlike some conventional slurry pumps, no special dome or spiral shape connecting the fluid chamber 36 and the output passage 32 is present.

In the preferred embodiment, both the input passage 26 and the output passage 32 have generally circular cross-sectional shapes. An input opening at the point where the input passage enters the fluid chamber 36 through the circular wall member 22 is circular. Because the output passage 32 is circular and tangential and passes through the circumferentially surrounding side wall member 24, an output opening at the point where the output passage 32 exits the fluid chamber 36 is generally elliptical.

In the preferred embodiment, the input passage 26 is offset in a radial direction opposite the intersection of the output passage 32 and the fluid housing 20. FIG. 2 best illustrates this orientation. More preferably, the axis of rotation 54 of the impeller 40 has a generally horizontal orientation and the input passage 26 is offset above the axis of rotation 54 in a generally vertical direction. FIG. 2 shows the input passage 26 located above the output passage 32.

As shown in FIGS. 2 and 3, the impeller 40 has a generally plate-shaped base member 44 where the axis of rotation 54 is located perpendicular to the base member and adjacent a center 56 of the base member 44. The fluid engaging face 42 of the impeller 40 presents a generally perpendicular face to the axis of rotation 54 that forms one border of the fluid chamber 36 and opposes the circular wall member 22 of the fluid housing 20. While the fluid engaging face 42 is generally perpendicular, the impeller 40 has specific elements, discussed below, at various angles which are not perpendicular to the axis of rotation.

Figure 4:
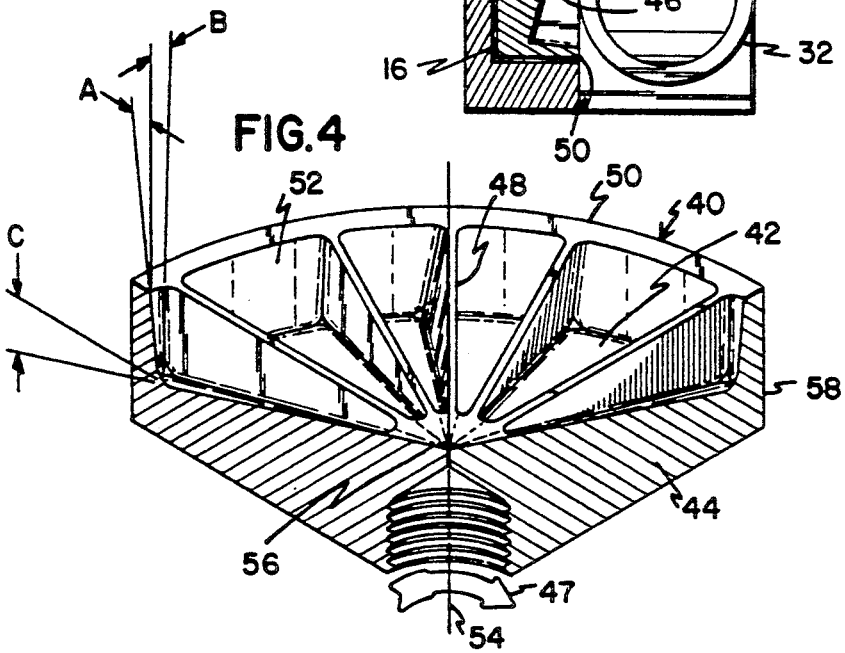
FIG. 4 is a partial cross-sectional view of a portion of the impeller of the slurry pump shown in FIG. 1.

The fluid engaging face 42 of impeller 40 has a fluid engaging surface 46 on the base member 44 which faces toward the fluid chamber 36 as best shown in the partial sectional view of FIG. 4. A plurality of fluid engaging blade members 48 are disposed on the fluid engaging surface 46 of the base member 44. The blade members 48 have generally uniform thickness. As best shown in FIG. 2, the blade members 44 converge adjacent the center 56 of the base member 44 and extend longitudinally in a general radial direction from the center toward an outer periphery 58 of the base member 44. A fluid engaging rim 50 extends from the fluid engaging surface 42 of the base member and surrounds the outer periphery of the base member 44. As can be seen best in FIG. 4, the blade members 48, the rim 50 and the fluid engaging surface 46 of the base member cooperate to form a plurality of wedge-shaped cavities or pockets 52 in the impeller 40 wherein each blade member forms a side wall of adjacent pockets.

As best shown in FIG. 4, the preferred embodiment of the impeller 40 has the blade members 48 sloping or tilted in the direction of rotation of the impeller, represented by Angle B, the direction of rotation being illustrated by an arrow 47. The impeller 40 further has the rim 50 diverging in a direction away from the center 56 of the base member 44, represented by Angle A, and the fluid engaging surface 42 of the base member 44 diverging from the center of the base member in a direction into the base member represented by Angle C. With this configuration, as illustrated in FIG. 4, each pocket 52 has increasing cross-sectional area in the radial direction. In one preferred embodiment, the blade members 48 slope at an angle of five degrees relative to the axis of rotation 58 of the impeller 40, the rim 50 diverges at an angle of five degrees relative to the axis of rotation 54 of the impeller 40, and the fluid engaging surface 42 diverges at an angle of 15 degrees relative to a perpendicular to the axis of rotation 54 of the impeller 40.

FIG. 2, which illustrates the preferred embodiment, shows the impeller 40 including sixteen (16) evenly spaced blade members 48. It is to be appreciated that the impeller could have any number of blade members configured as described above and still function properly.

During operation, the fluid enters the fluid chamber 36 through the input passage 26 generally perpendicular to the fluid engaging face 42 of the impeller 40 as shown by the arrow in FIG. 3. The rotating blade members 48 disposed on the impeller apply a shearing action to the fluid. A portion of the fluid further engages the rim and the fluid engaging surface of the base member of the impeller. Preferably, the majority of the solid particles suspended in the fluid entering the pump housing through the input passage remain in the fluid chamber to minimize contact with the impeller.

Figure 8:
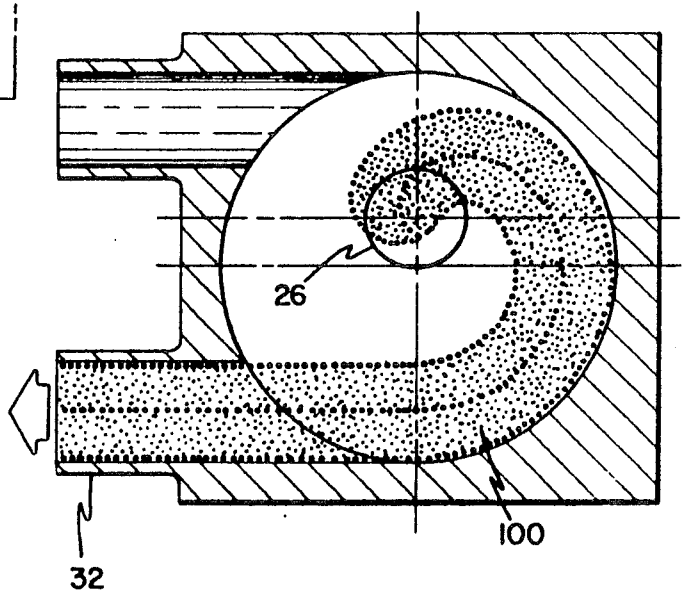
FIG. 8 is a schematic view showing the typical fluid flow path through the slurry pump shown in FIG. 1.

The impeller and fluid interaction creates a pressure differential which draws or forces more fluid into the fluid chamber 36 as the impeller 40 drives the previously entered fluid toward the output passage 32. The impeller 40 drives the fluid from the input passage 26 through the fluid chamber 36 in a general 180 degree spiral shape traveling clockwise as viewed in FIG. 2 toward the output passage 32. Preferably, the fluid flow is driven by the impeller in a spiral angular motion. FIG. 8 illustrates in schematic view fluid flow 100 having spiral angular motion as typically might occur during operation of the slurry pump of the present invention. By using an impeller as described above in conjunction with the perpendicular and offset input passage 26, the fluid is more uniformly driven by the impeller through the pump housing 12.

Preferably, an inside diameter of the output passage 32 and an inside diameter of the input passage 26 are substantially equal. Furthermore, a width of the inside surface cf the side wall member 24 between the impeller 40 and the opposing circular wall member 22 is preferably substantially equal to the diameters of the input passage and the output passage. With this configuration the fluid flow entering the fluid chamber 36 and traveling through the fluid chamber to the output passage 32 maintains the same general cross-sectional shape as the input passage 26. Because the fluid maintains the same general cross-sectional shape in the fluid chamber 36, there is no substantial kinetic energy loss that might occur if the fluid in the fluid chamber 36 were permitted to expand or contract before entering the output passage 32.

As best shown in FIG. 2, an L-shaped feedback input passage 70 links the output passage 32 back to the fluid chamber 36. The feedback input passage 70 permits a portion of the fluid exiting the fluid chamber 36 via the output passage 32 to return as illustrated by arrows in FIG. 2 to the fluid chamber. Preferably, the feedback passage 70 permits a low percentage such as five to ten percent of the output fluid to reenter the fluid chamber 36.

By permitting a small amount of the output to be fed back to the fluid chamber 36, the feedback fluid compensates for small irregular loads that enter the fluid chamber 36 via the input passage to prime the pump. By reentering the fluid chamber, the feedback fluid reduces the impact that these irregularities have on the output fluid flow, producing a more uniform output and reducing the likelihood that the pump will lose prime or head pressure. In general, the feedback flow is continuous and has the same ratio of insoluble matter to fluid as the output flow. Because the feedback flow is continuous, the feedback feature creates a dynamic and continual prime. While the slurry pump 10 shown in the figures has a single feedback input passage, it is to be appreciated that the slurry pump could have additional feedback input passages to further improve the uniformity of the fluid flowing from the output passage, and reduce the likelihood of the pump losing prime due to input irregularities.

The slurry pump 10 shown in the figures includes structure for changing the operation of the feedback input passage feature to adjust for different types of fluids being transported by the pump 10, i.e. varying the size of the insoluble matter or varying the insoluble matter to fluid ratio. One method of changing the feedback characteristics is to change the cross-sectional dimensions of the feedback input passage 70. It is to be appreciated that the structure for varying the size of the feedback input passage could be automatically adjustable such as a two-position, four-way solenoid operated spring return valve with a sensing element on the input side of the pump housing to regulate the valve position.

The structure might be manually adjustable and might include a valve or other structure that permits varying of the size of the passage. Also, FIG. 5A illustrates an apertured disk 78 which may be manually placed in the feedback input passage to vary the size of the passage. The disk 78 may be placed between extension 84 and coupling 86 of the slurry pump 10 which are threadably connected in the embodiment shown. FIG. 2 illustrates a disk 78 positioned in the feedback input passage 70 between extension 84 and coupling 86. The disk 78 illustrated in FIG. 5A has an aperture 80 which is smaller than the inside diameter of the feedback input passage 70. Various other disks can be inserted instead of the disk shown in FIG. 5A that have apertures bigger or smaller than the aperture shown in the disk illustrated in FIG. 5A. In general, the size of the aperture required to maintain a similar percentage of fluid feeding back into the fluid chamber decreases as the fluid includes less insoluble matter.

Figure 5B:
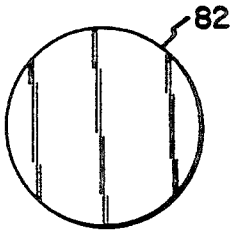
FIG. 5B is a front view of a solid disk which is mountable to the slurry pump shown in FIG. 1.
Figure 5A:
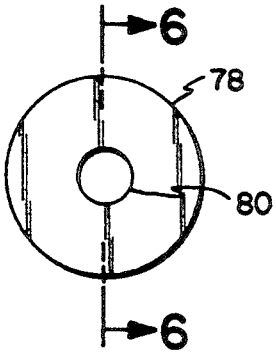
FIG. 5A is a front view of an apertured disk which is mountable to the slurry pump shown in FIG. 1.
Figure 6:
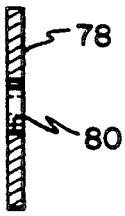
FIG. 6 is a cross-sectional side view of the apertured disk shown in FIG. 5A.

FIG. 5B illustrates a disk similar to the disk shown in FIG. 5A but without an aperture. The solid disk 82 in FIG. 5B can be used to eliminate the feedback input passage effect entirely without having to restructure the pump to eliminate the feedback input passage.

The capacity of the slurry pump 10 of the present invention can be changed to adjust to different flow requirements. One method of changing the capacity of the pump is to increase or decrease the impeller 40 rotation speed. Another method is to change the input passage 26 and output passage 32 diameters. One way to accomplish this is to add disks with apertures, like that shown in FIG. 5A, to the input passage 26 and the output passage 32.

Figure 7:
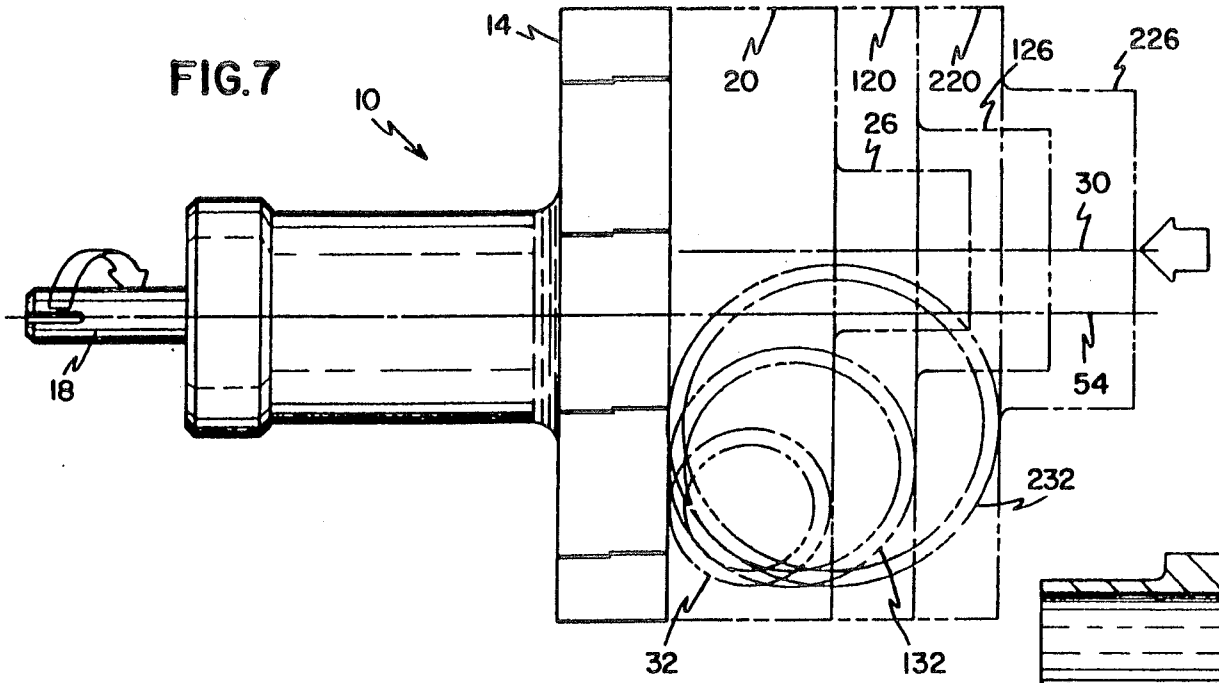
FIG. 7 is a diagrammatic drawing of the slurry pump shown in FIG. 1 showing multiple fluid housings that are interchangeably mounted to the impeller housing.

Another way of changing the pump characteristics for increased or decreased fluid flow is to replace entirely the fluid housing 20 with another fluid housing having different dimensions. The replacement fluid housing having at least one different dimension than the fluid housing it replaced mates with the existing impeller housing and impeller to change the pump capacity. To further adapt the pump to different flow requirements, several different fluid housings can be provided, all having different sizes. FIG. 7 illustrates multiple fluid housings 20, 120, 220 with different dimensions super help show the different dimensions as well as the manner in which each one mates with the existing impeller housing 14. If the input passage diameter, the output passage diameter, and the side wall member width are equal, the replacement fluid housing preferably has all three dimensions equally increased or decreased to maintain the benefits of equal sizes as discussed previously. FIG. 7 illustrates the multiple housings 20, 120, 220 with input passages 26, 126, 226 and output passages 32, 132, 232. Each housing has equal dimensions which are different from each other fluid housing. As shown in FIG. 7, the input passages preferably share the same centerline 30 and the output passages 32, 132, 232 are tangent adjacent the bottom of the passages. With multiple interchangeable housings, a multi-capacity pump can be provided that is easily changeable with minimal parts and/or labor.

As shown in FIGS. 1 and 2, attached to the feedback input passage 70 is an initial prime passage 72. An initial prime valve 92 permits opening and closing of the initial prime passage 72. The initial prime passage 72 is used during start up of the pump. As shown in FIG. 1, an output valve 90 is located on the output passage 32 to permit opening and closing of the output passage. During initial start up, the distal end of the input passage 26 is submerged int eh fluid to be transported and an input valve 88 moved to the open position. The output valve 90 is positioned to close the output passage 32. The initial prime valve 92 is positioned to open the initial prime passage 72. A fluid such as water is poured into the pump housing 12 through the initial prime passage 72 to fill the cavities in the pump housing and in the input passage 26 back toward the fluid to be transported. Once the cavities are filled, the initial prime valve 92 is moved to the closed position and the power source of the slurry pump 10 is started. As the impeller 40 rotates, pressure builds in the pump housing 12. When the pressure reaches a sufficient level, the output valve 90 is moved to the open position to open the output passage 32. At this point, the slurry pump 10 is operational and fluid flows through the pump housing 12 from the input passage 26 to the output passage 32.

As shown in FIG. 2, the open end of the initial input passage 72 has external threads 76 for threadably attaching a supply of priming fluid to the initial input passage. When the priming fluid supply is not attached, an internally threaded cap 74 can be place on the initial prime passage as shown in FIG. 1.

During operation of the slurry pump 10, a fluid film typically forms along the inside surfaces of the pump housing 12. This fluid film generally does not contain as much solid material as the fluid entering the pump and therefore functions as a cushion for solids hitting the housing walls. The fluid film protects the surfaces from impact thereby reducing wear and damage to the parts of the pump and producing a quieter pump.

It should be appreciated that the slurry pump of the present invention could be easily transported by a prime mover such as a truck. Because the pump is transportable, the slurry pump can be taken to locations wherever pumping of fluids is desired. The slurry pump can be mounted on a platform with or without wheels to facilitate transportability. The power source which rotatably drives the shaft and the impeller can also be mounted on the platform. In addition to being easily transportable, the slurry pump of the present invention can be used to pump a wide variety of fluids including sewage, sludge, fluid containing sand or gravel, and cement. It is anticipated that the slurry pump would have practical uses both commercially and privately.

The slurry pump of the present invention converts mechanical motion of the rotating impeller to fluid motion of the fluid. Unlike some conventional slurry pumps, the slurry pump in the present invention produces a uniform output of fluid flowing from the output passage even when random and intermittent deviations and irregularities exist in the fluid flowing through the pump housing. Sometimes these irregularities are such that they may cause a loss of prime in some conventional pumps, requiring repriming to restart the pumping process. The present invention overcomes these problems to produce a more steady output flow and reduce the likelihood that the pump will lose prime. As discussed above, the preferred embodiment of the present invention has a fluid chamber 36 adjacent the impeller 40. However, it is to be appreciated that the various features of the present invention, such as the feedback feature and the perpendicular and offset input passage feature, could be employed in a pump that does not have a fluid chamber thereby producing in that pump a more steady output and reducing the likelihood that the pump will lose prime.

It is to be understood, that even though numerous characteristics and advantages of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad, general meaning of the terms in which the appended claims are expressed.

What is claimed is:

1. A fluid housing mountable to an impeller housing of a slurry pump wherein the impeller housing contains a rotatable impeller rotatable about an axis of rotation, the fluid housing comprising:

a circular wall member opposing the impeller and having a substantially circular input passage eccentrically located relative to a center of the circular wall member, the input passage further being eccentrically located relative to the axis of rotation of the impeller; and a circular side wall member surrounding the circular wall member about an outer periphery of the circular wall member, the circular side wall member having a substantially circular output passage, the circular side wall member being mountable to the impeller housing wherein the circular wall member and the circular side wall member of the fluid housing cooperate with the impeller housing to define a fluid chamber, the impeller of the impeller housing being located substantially outside the fluid chamber;

the circular side wall member having an interior width substantially equal to an inside diameter of the input passage and an inside diameter of the output passage.

2. The fluid housing of claim 1 wherein the input passage has a centerline which is offset at least ⅛ and no greater than ½ of the inside diameter of the input passage.

3. An adjustable capacity pump comprising:

an impeller having an axis of rotation and a fluid engaging face;

an impeller housing having an impeller chamber receiving the impeller, the impeller being rotatably mounted in the impeller chamber for rotation about the axis of rotation;

a fluid housing having a circular wall member opposing the fluid engaging face and a side wall member surrounding the circular wall member, the fluid housing cooperating with the impeller housing to form a fluid chamber defined by the circular wall member, the side wall member, and the fluid engaging face, the impeller located substantially outside the fluid chamber, the circular wall member having an input passage linking an exterior of the fluid housing to the fluid chamber, the side wall member having an output passage linking the fluid chamber to an exterior of the fluid housing, the input passage permitting fluid entering the fluid chamber to engage the fluid engaging face of the impeller during rotation of the impeller about the axis of rotation wherein the fluid is directed by the impeller through the fluid chamber toward the output passage to exit the fluid chamber; and the capacity of the pump being adjustable by interchanging the fluid housing with another fluid housing wherein an inside diameter of the input passage and an inside diameter of the output passage are varied by interchanging the fluid housing.

4. The adjustable capacity pump of claim 3, wherein an inside width of the side wall member between the circular wall member and the fluid engaging face is varied by interchanging the fluid housing.

5. The adjustable capacity pump of claim 3, wherein the inside diameter of the input passage, the inside diameter of the output passage, and a side wall member width are varied equally by interchanging the fluid housing.

6. A slurry pump apparatus kit comprising:

an impeller having an axis of rotation and a fluid engaging face;

an impeller housing having an impeller chamber for receiving the impeller, the impeller being rotatably mounted in the impeller chamber for rotation about the axis of rotation; and a plurality of interchangeable fluid housings each having a circular wall member and a side wall member surrounding the circular wall member, each fluid housing interchangeably cooperating with the impeller housing to form a fluid chamber defined by the fluid engaging face and the circular wall member and the side wall member of each fluid housing, the impeller located substantially outside the fluid chamber, each fluid housing having an input passage linking an exterior of the fluid housing to the fluid chamber, each fluid housing further having an output passage linking the fluid chamber to an exterior of the fluid housing, the input passage permitting fluid entering the fluid chamber to engage the fluid engaging face of the impeller during rotation of the impeller about the axis of rotation wherein the fluid is directed by the impeller through the fluid chamber toward the output passage to exit the fluid chamber, each fluid housing further having equal dimensions for an interior width of the side wall member, an inside diameter of the input passage, and in inside diameter of the output passage; each fluid housing further having different dimensions than the other fluid housings.

7. The slurry pump apparatus of claim 6, wherein the impeller directs the fluid through the fluid chamber in a spiral angular motion.

* * * * *

UNITED STATES PATENT AND TRADEMARK OFFICE

CERTIFICATE OF CORRECTION

PATENT NO. : 5,114,312

DATED : May 19, 1992

INVENTOR(S) : Stanislao

It is certified that error appears in the above-identified patent and that said Letters Patent is hereby corrected as shown below:

In the Abstract, line 26
DELETE "passage" and INSERT therefor --passages--

Column 2, line 26
INSERT "the" after the word "reenter".

Column 3, line 55
INSERT --a-- after the word "forms".

Column 3, line 55
DELETE "packets" and INSERT therefor --pockets-.

Column 3, line 56
INSERT --an-- after the word "has".

Column 4, line 8
INSERT --the-- after the word "reenter".

Column 4, line 9
DELETE "have" and INSERT therefor --having--.

Column 4, line 60
DELETE "an" and INSERT therefor --and--.

Column 5, line 62
DELETE "12" and INSERT therefor --26--.

Column 5, line 63
DELETE "engaging 42 face" and INSERT therefor --engaging face 42--.

UNITED STATES PATENT AND TRADEMARK OFFICE

CERTIFICATE OF CORRECTION

PATENT NO. : 5,114,312

DATED : May 19, 1992

INVENTOR(S) : Stanislao

It is certified that error appears in the above-identified patent and that said Letters Patent is hereby corrected as shown below:

Column 6, line 37
DELETE "perpendicular" and INSERT therefor --parallel--.

Column 7, line 46
INSERT --an-- after the word "has".

Column 10, line 9
DELETE "int eh" and INSERT therefor --in the--.

Column 12, claim 6, line 54
DELETE "in" and INSERT therefor --an--.

Signed and Sealed this

Twelfth Day of October, 1993

Bruce Lehman

*Attest:*

BRUCE LEHMAN

*Attesting Officer*

*Commissioner of Patents and Trademarks*